US006505710B1

(12) United States Patent
Kato

(10) Patent No.: US 6,505,710 B1
(45) **Date of Patent: *Jan. 14, 2003**

(54) MAST APPARATUS FOR FORK LIFT TRUCKS

(75) Inventor: Yoshiichi Kato, Tokyo (JP)

(73) Assignee: Nissan Motor Co., Ltd., Kanagawa-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/170,062

(22) Filed: Oct. 13, 1998

(30) Foreign Application Priority Data

Oct. 14, 1997 (JP) ..... 9-279272
Oct. 15, 1997 (JP) ..... 9-280975

(51) Int. Cl.[7] ..... B66F 9/06

(52) U.S. Cl. ..... 187/230; 187/227; 187/226; 187/228

(58) Field of Search ..... 187/227, 228, 187/226, 230, 238

(56) References Cited

U.S. PATENT DOCUMENTS 2,791,293 A * 5/1957 Schenkelberger ..... 187/228
2,979,162 A * 4/1961 Quayle ..... 187/227
3,208,556 A * 9/1965 Shaffer
3,394,778 A * 7/1968 Brinton ..... 187/227
4,356,893 A * 11/1982 Johannson ..... 187/227
4,442,922 A * 4/1984 Johannson
4,593,791 A * 6/1986 Matthews ..... 187/226
4,721,187 A * 1/1988 Riddle ..... 187/227
4,889,038 A * 12/1989 Bentivoglio ..... 187/226 X
5,046,585 A * 9/1991 Ohta et al.
5,657,834 A * 8/1997 Plaugher et al. ..... 187/226

FOREIGN PATENT DOCUMENTS

JP 59-123096 * 8/1984
JP 62-132099 8/1987
JP 405319792 * 12/1993 ..... 187/227

* cited by examiner

*Primary Examiner*—Robert P. Olszewski
*Assistant Examiner*—Steven B. McAllister
(74) *Attorney, Agent, or Firm*—McDermott, Will & Emery

(57) ABSTRACT

A triple mast type, slide type full free lift mast comprises a mast combination composed of an inner mast member, a middle mast member and an outer mast member, a combination of a free lift cylinder and a lift cylinder provided for the mast combination, and a chain for driving the inner mast member, the chain intervening between the inner mast member and the middle mast member. The inner mast member is higher in top level than the middle and outer mast members, as a lift bracket is held in a lowest position, and a chain wheel for the chain to be applied thereover is provided at an upper end part of the middle mast member, residing between a top level of the inner mast member and a top level of the middle mast member.

11 Claims, 11 Drawing Sheets

MAST APPARATUS FOR FORK LIFT TRUCKS

BACKGROUND OF THE INVENTION

The present invention relates to a mast apparatus for fork lift trucks.

More specifically, the invention relates to a mast apparatus as "a mast with a mechanism for having an unchanged mast height until a lift bracket reaches an upper end of an inner mast" (hereafter sometimes called "a full free lift mast"), as "a mast of a system having outer mast faces as guides for an inner mast to slide up and down" (hereafter sometimes called "a slide type mast") and as a mast of a triple mast type having a pair of left and right full free lift cylinders independently provided or separated from each other and a pair of left and right lift cylinders likewise provided for a load handling service, as well as to a mast apparatus as a full free lift mast of a triple mast type.

There is disclosed in Japanese Utility Model Application Laid-Open Publication No. 59-123096, as well as in Japanese Utility Model Application Laid-Open Publication No. 62-132099, a so-called "wide angle" mast apparatus allowing for an operator to have a wide front sight.

FIG. 1 is a schematic plan of a conventional wide sight mast apparatus.

The conventional mast apparatus has as mast members thereof a pair of left and right inner mast members 105, a pair of left and right middle mast members 106, and a pair of left and right outer mast members 102, and further includes as hydraulic cylinders associated therewith a pair of left and right lift cylinders 101 disposed behind the outer mast members 102, and a pair of left and right free lift cylinders 104 arranged behind the inner mast members 105, for lifting a pair of left and right lift brackets 103 fixed to a finger bar 107.

The conventional mast apparatus is different from a mast apparatus having a free lift cylinder of a relatively large diameter between left and right mast members (see FIG. 12B), in that an operator on a driver's seat has a front sight free of an interruption at a central region of the sight. However, behind the left and right mast members 102, 105 and 106, there are installed mast drives, such as a chain and a hydraulic piping, interrupting oblique front sights of the operator, splitting them, killing in part, needing extra considerations, such as for a coping with a delicate shift of the eye point, such as when visually checking a fork action.

A conventional mast apparatus of a triple mast type is disclosed in Japanese Utility Model Application Laid-Open Publication No. 59-123096.

This conventional mast apparatus includes an inner mast member with which a lift bracket is supported and which has a free lift cylinder mounted thereon for lifting the lift bracket, a middle mast member, and an outer mast member which is provided with a lift cylinder for elevating the middle mast member. The lift bracket is elevated by operating the free lift cylinder until it reaches an upper limit relative to the inner mast member, before an operation of the lift cylinder by which the middle mast member is elevated at a speed and with which the inner mast member is caused to ascend by a double stroke at a double speed, as it is driven with a chain in dependence on an elevation of the middle mast member.

In this mast apparatus, the inner, middle and outer mast members are arranged so that they have an even height when the lift bracket is positioned at a lower limit, with a resultant restriction to a free lift stroke of the lift bracket that is relatively short.

SUMMARY OF THE INVENTION

The present invention has been achieved with such points in view.

It therefore is an object of the invention to provide a mast apparatus having a mast drive possibly kept from interrupting an operator's sight, as well as from splitting the sight or killing the same in part, thereby permitting a relatively wide defined sight.

Another object of the invention is to provide a mast apparatus of a triple mast type with a relatively long free lift stroke.

An aspect of the invention provides a mast apparatus of a triple mast type as a slide type full free lift mast, the mast apparatus comprising a mast combination composed of an inner mast member, a middle mast member and an outer mast member, a combination of a free lift cylinder and a lift cylinder provided for the mast combination, and a chain for driving the inner mast member, the chain intervening between the inner mast member and the middle mast member.

According to this aspect of the invention, a drive chain for an inner mast member intervenes between the inner mast member and a middle mast member, which either or both overlap the chain in a sight angle of an operator. In other words, "a region of sight field to be killed by the chain" (hereafter referred to as "a first dead zone") overlaps "a region of sight field killed by the inner mast member and/or the middle mast member" (hereafter referred to as "a second dead zone"), and an interruption of the chain that would have been visible in a sight of the operator is eliminated in dependence on a degree of overlap between the first dead zone and the second dead zone, with a reduced frequency of occurrences of sight split and a reduced degree of sight killing, allowing for the wider defined sight.

Further, a mast apparatus according to the aspect of the invention may have a chain drive including a chain wheel and a chain applied over the chain wheel. Therefore, according to the invention, an intervening chain between inner and outer mast members may be adaptive for a transverse chain drive arrangement, in which a chain wheel may have a transversely extending wheel face that may effectively overlap a combination of mast members, when observed in a longitudinal direction of a fork lift truck, permitting an outside dimension of the mast apparatus to be reduced in the longitudinal direction, allowing for the fork lift truck to have a relatively short front overhang between a front axle and the lift bracket.

Another aspect of the invention provides a mast apparatus of a triple mast type as a full free lift mast provided with a lift bracket, the mast apparatus comprising a mast combination composed of an inner mast member, a middle mast member and an outer mast member, the inner mast member being higher in top level than the middle and outer mast members, as the lift bracket is held in a lowest position thereof, a chain for driving the inner mast member to be elevated and lowered, and a chain wheel for the chain to be applied thereover, the chain wheel being provided at an upper end part of the middle mast member and residing between a top level of the inner mast member and a top level of the middle mast member.

According to this aspect of the invention, a mast apparatus of a triple mast type as a full free lift mast has an inner mast member higher in a set-up top level (in terms of a lowered mast height) than middle and outer mast members, and an inner-mast-lifting chain wheel provided at an upper end part of the middle mast member and accommodated within a difference between top levels of the inner and middle mast members, so that a free lift stroke for a lift bracket to be solely elevated and lowered relative to the inner mast member depends on a length of the inner mast member, without restriction from a length of the middle or outer mast member, and is allowed to have a long dimension, in addition to that a chain wheel projecting over the middle mast member is kept from exceeding the top level of the inner mast member, and is protected by the inner mast member against a collision with external obstacles, such as when a fork lift truck equipped with the mast apparatus travels.

In other words, as an inner mast member is taller than a middle mast member by a predetermined difference of height, as well as than an outer mast member, the free lift stroke for a lift bracket to be moved relative to the inner mast member depends on a length of this mast member, in free of restrictions due to a height of the middle or outer mast member.

Further, a chain wheel for an inner-mast-driving chain is accommodated within a height difference between from the middle mast member to the inner mast members, i.e., its projection height over that mast member never exceeds a height of this mast member, which mast height effectively protects the chain wheel against collisions that otherwise might occur, such as with an external structure.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
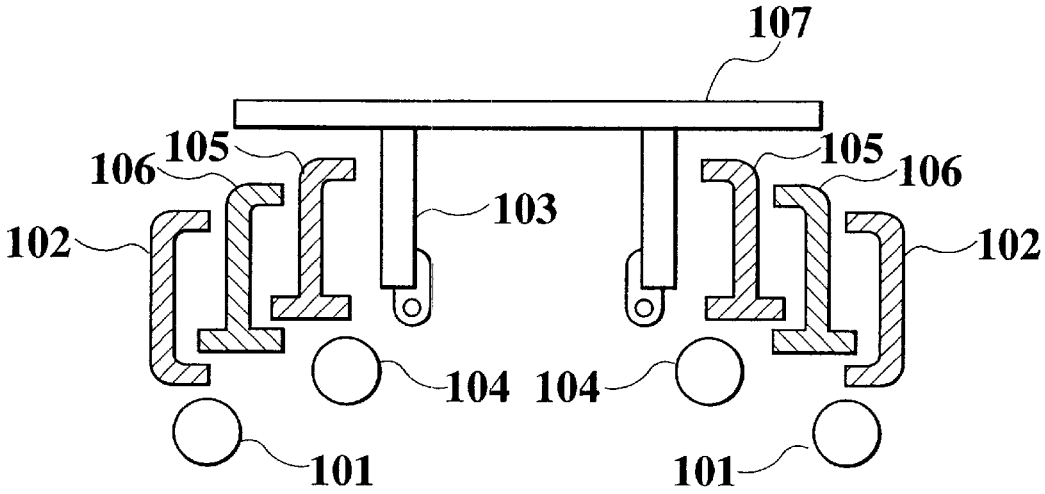
FIG.1 PRIOR ART
FIG. 1 is a schematic plan of a conventional wide sight mast apparatus.

There will be described below the preferred embodiments of the invention with reference to the accompanying drawings. Like members are designated by like reference characters.

Figure 2:
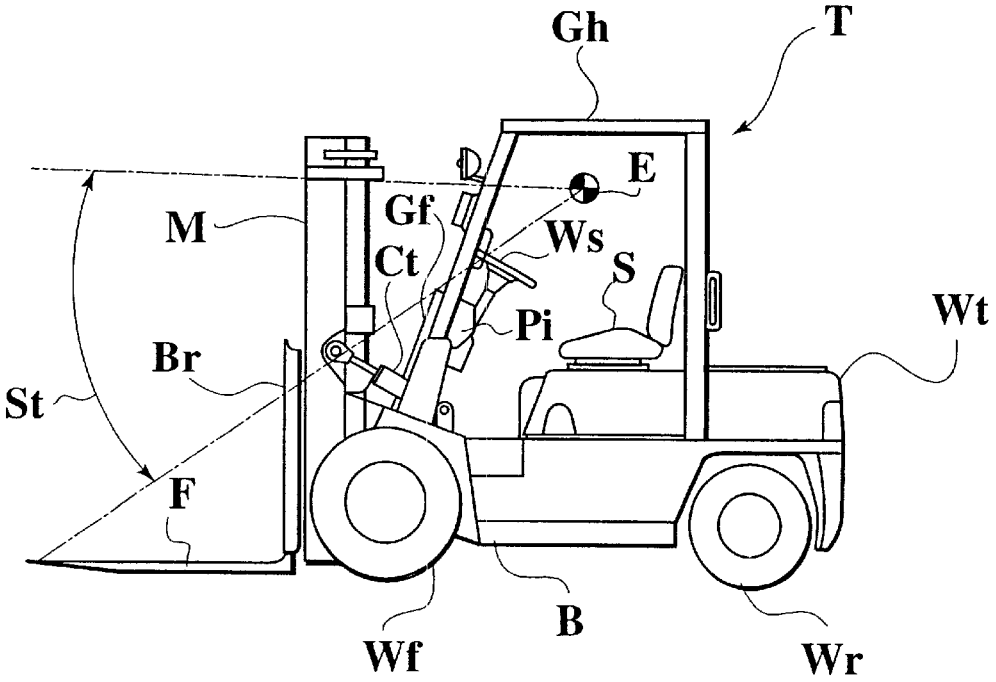
FIG. 2 is a side view of a fork lift truck equipped with a mast apparatus according to an embodiment of the invention.

FIG. 2 is a side view of a fork lift truck T equipped with a mast apparatus M according to a first embodiment of the invention.

The fork lift truck T comprises: a vehicle body B provided with an unshown swingable rear axle supporting a pair of left and right steering rear wheels Wr, a counter weight Wt, a head guard Gh, a front guard Gf, and an unshown rigid front axle supporting a pair of left and right driving front wheels Wf; and the mast apparatus M of a triple mast type as a slide type full free lift mast pivoted at a later-described mast support on a front lower part of the vehicle body B and operatively connected via a pair of left and right tilt cylinders Ct to front upper parts of the vehicle body B. The mast apparatus M has a load-backrest Br attached to a later-described finger bar, and a fork F comprised of a pair of angled arms hooked on the finger bar. The mast apparatus M may have a side shift and/or a reach fork.

The vehicle body B has mounted thereon: a vehicle drive system including an engine and a power train having a transmission; an operation system including a steering wheel Ws projecting over an instrument panel Pi which is substantially flush at a top with the front guard Gf, and acceleration and brake pedals, as well as mast and fork control levers and/or switches; a hydraulic system including a pump, hydraulic circuitry and a reservoir; an electrical system including a generator, a battery assembly, electric circuitry, controls, indicators, lights, etc.; and a driver's seat S for an operator to sit thereon with a normal eye point E covering a normal sight including a vertical sight St between from a top of the front guard Gf at least to an edge of an uppermost cross beam of the mast apparatus T or thereover and a voluntary horizontal sight with a minimized dead zone (FIG. 12A), permitting a direct observation of a tip of each fork arm even at a lowest position thereof.

FIGS. 3 to 9 illustrate the first embodiment, in which a pair of left and right outer mast members 1 each have (as in FIG. 4) integrated thereto a corresponding one of cylinder tubes 15 of a pair of left and right lift cylinders 2 of a ram type, i.e. of a type that has a magnitude of drive power depending on a difference between sectional areas of a plunger different in diameter times a hydraulic pressure acting on the sectional areas.

As shown in FIGS. 3 to 6, a pair of left and right middle mast member 3 are vertically slidably arranged at inner sides of the left and right outer mast members 1 integrated with the left and right lift cylinders 2, and a pair of left and right inner mast members 4 are vertically slidably arranged at inner sides of the left and right middle mast members 3. The left and right outer mast members 1 are rigid-connected to each other by an upper beam 5, a cross beam 6 and a mast support 7, to constitute an integrated outer mast. The left and right middle mast members 3 are rigid-connected to each other by an upper beam 9 and an unshown lower beam, to constitute an integrated middle mast. The left and right inner mast members 4 are rigid-connected to each other by a mast head 10 and a lower beam 11, to constitute an integrated inner mast.

Figure 5:
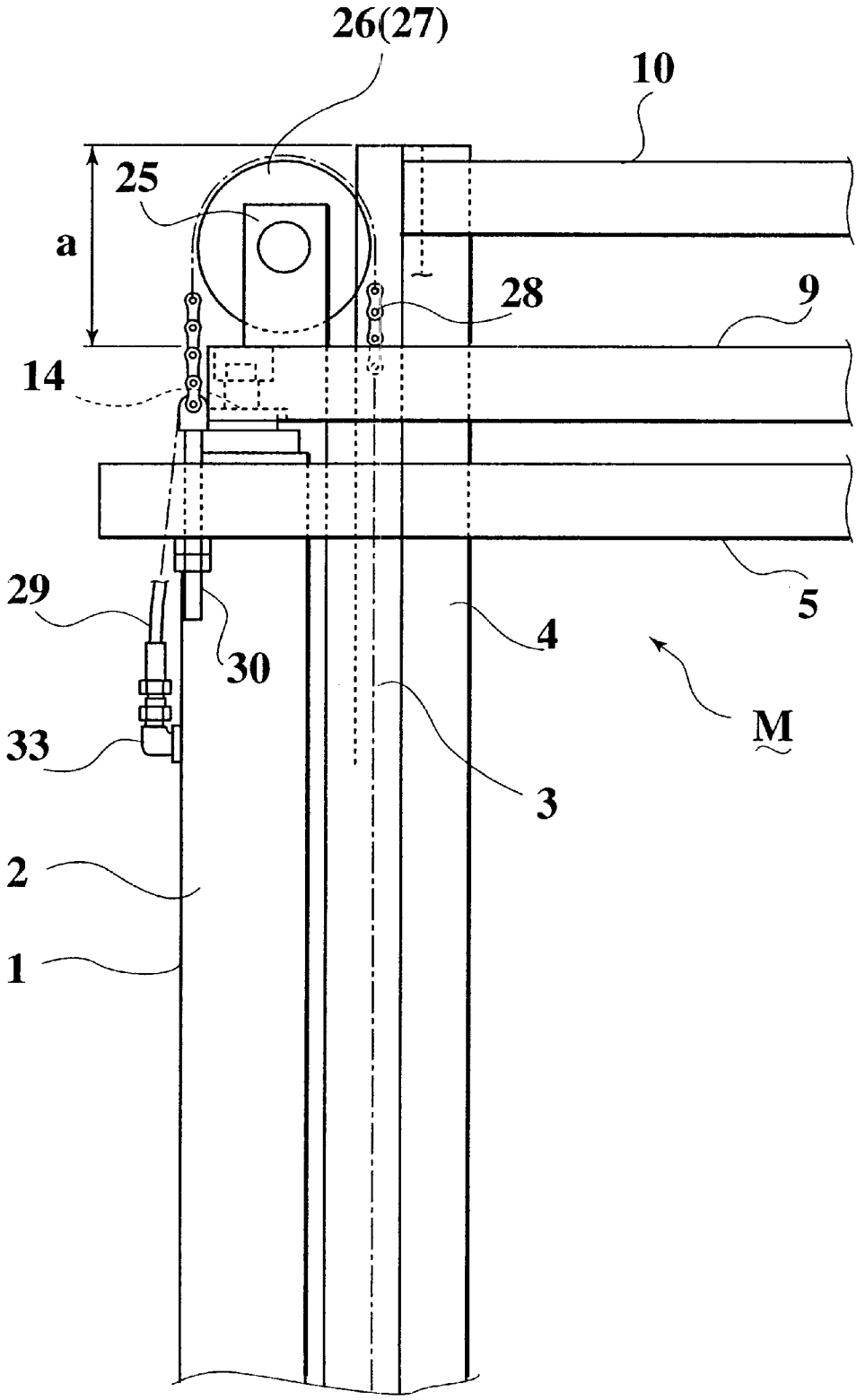
FIG. 5 is a rear view of an essential portion of the mast apparatus, along arrow A of FIG. 3.

A pair of left and right vertical lift brackets 12 are vertically movably arranged at respective inner sides of the left and right inner mast members 4, and a horizontal finger bar 13 (as a carriage member) is fixed to the left and right lift brackets 12, with the fork F (FIG. 2) hooked on the finger bar 13. As shown in FIG. 5, the left and right lift cylinders 2 each have a rod (a ram or a plunger) 14 connected at an upper end thereof to a corresponding part of the middle mast (i.e. either end of the upper beam 9 in this case).

Figure 4:
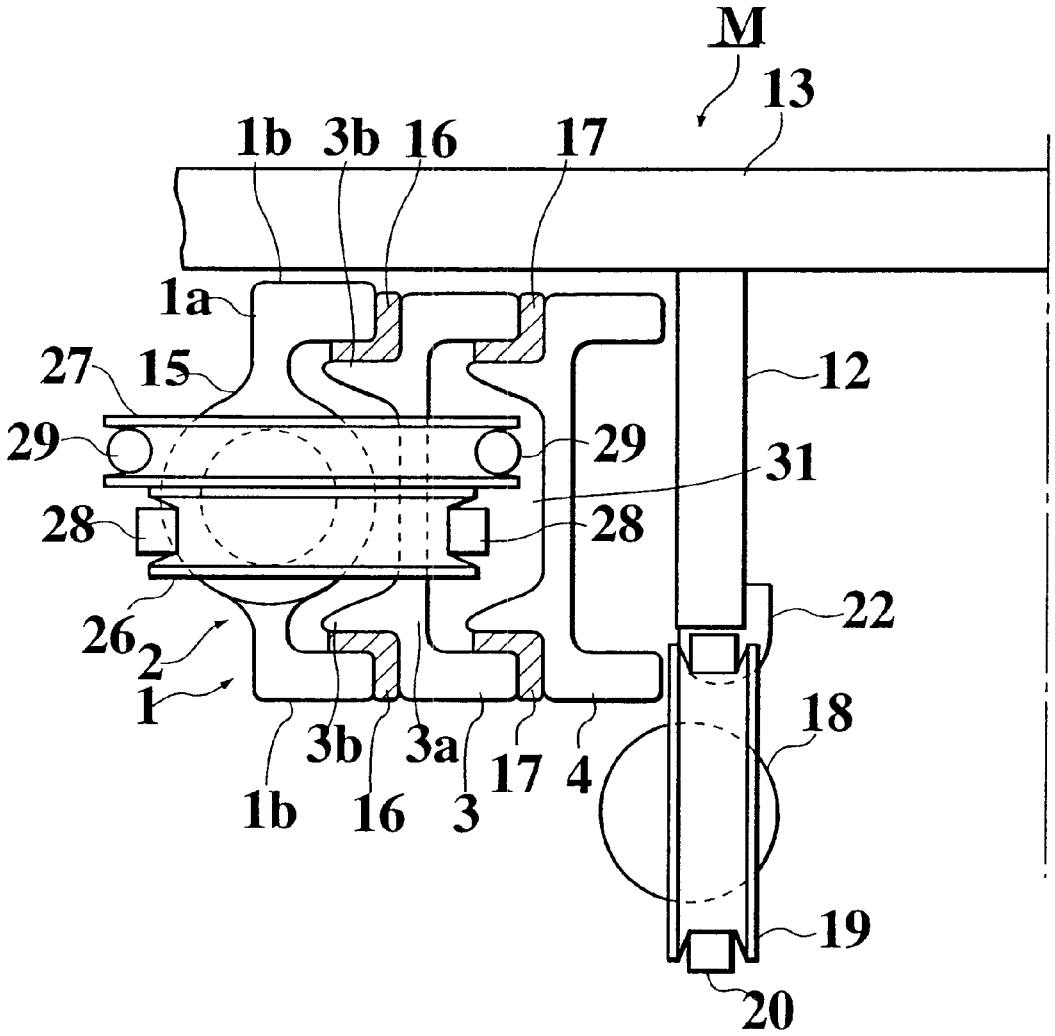
FIG. 4 is a plan of an essential portion of the mast apparatus.
Figure 6:
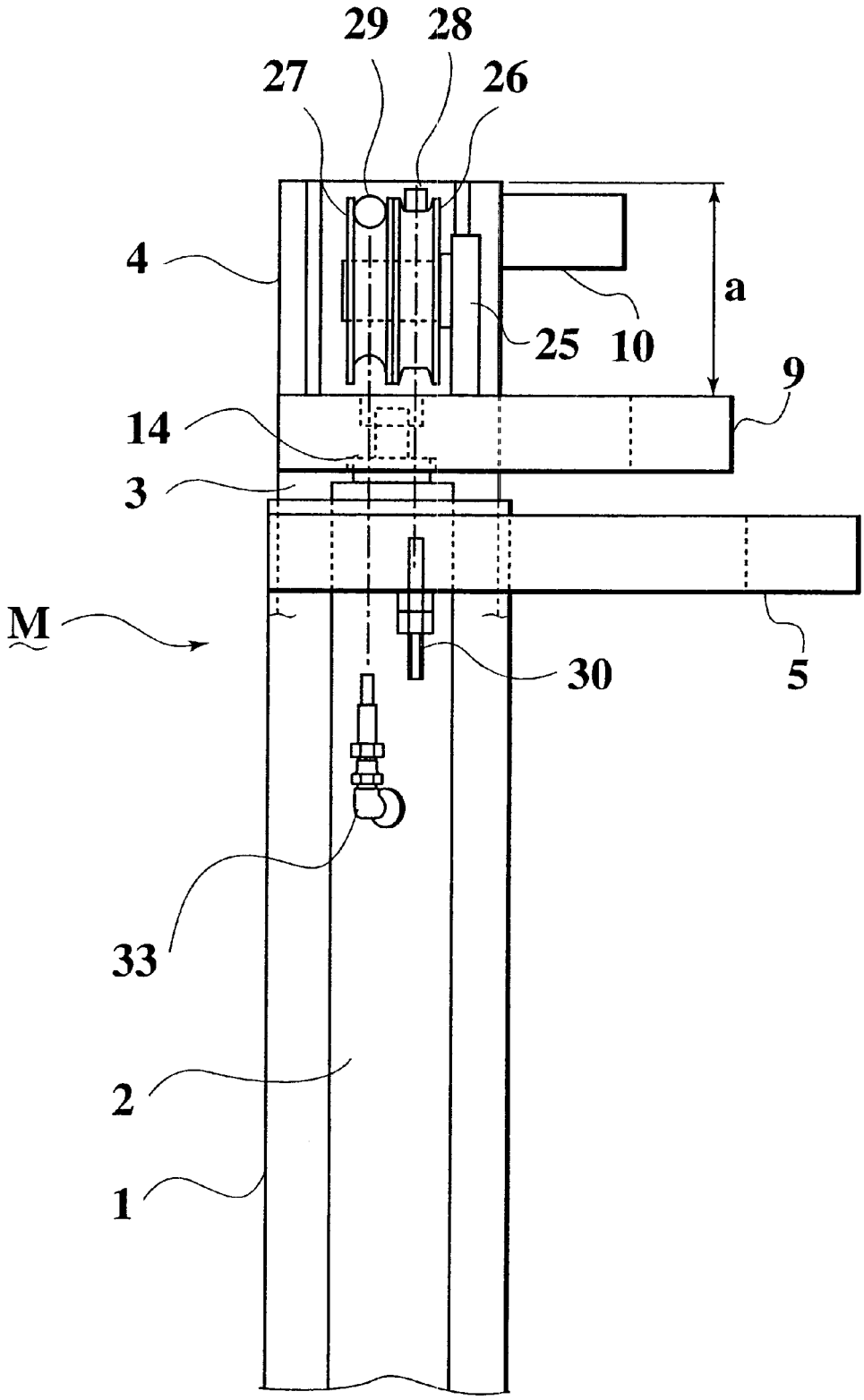
FIG. 6 is a side view of an essential portion of the mast apparatus, along arrow B of FIG. 3.

As shown in FIGS. 4 to 6, each middle mast member 1 is dimensioned to be higher in top level than a respective outer mast member 3, and each inner mast member 4 is dimensioned to be higher in top level than the middle mast 3 by a predetermined amount as a level difference 'a'. This level difference 'a' between the middle and inner mast members 3 and 4 at each of the left and right sides of the mast apparatus M is employed for accommodating therein a combination of a chain wheel 26 for a corresponding one of a pair of left and right lift chains 28 for lifting the inner mast and a wheel 27 for a corresponding one of a pair of left and right hydraulic horses 29 to be wound thereon.

As shown in FIG. 4, each outer mast member 1 is shaped substantially in a C-channel form and comprises, in cross section, a pair of vertically extending front and rear flange portions 1*b*, a web 1*a* interconnecting the flange portions 1*b* with each other, and a hollowed annular wall as the cylinder tube 15 of the lift cylinder 2 integrally formed in an intermediate part of the web 1*a*. The middle mast member 3 arranged inside the outer mast member 1 also is shaped substantially in a C-channel form and comprises, in cross section, a pair of front and rear flange portions, a web 3*a* interconnecting these flange portions with each other, and a pair of front and rear ribs 3*b* as outward projections formed on a back of the web 3*a*. A shoulder-like step at a frontwardly or rearwardly outer side of each of these ribs 3*b* confronts a rearwardly or frontwardly inner edge of an end part of a corresponding one of the front and rear flange portions 1*b* of the outer mast member 1, with a resin liner 16 interposed therebetween and shaped in an L form as a guide for the edge of flange portion 1*b* to be slid thereon to vertically move relative to the step of rib 3*b*. Between the middle and inner mast embers 3 and 4, there also is provided like sliding guide structure employing a resin liner 17.

Each outer mast member 1, each middle mast member 3 and each inner mast member 4 are arranged within a longitudinally outside dimension of the outer mast, more specifically within an outside dimension of the outer mast member 1 in a longitudinal direction of the fork lift truck T, without mutually offsetting in the longitudinal direction.

The outer mast member 1 and the cylinder tube 15 of the lift cylinder 2 integrated therewith overlap each other in a transverse direction of the fork lift truck T, as a matter of course. The cylinder tube 15 and the middle mast member 3 also overlap each other in the transverse direction. With respect to a respective one of left and right combinations of the outer, middle and inner mast members 1, 3 and 4, the mast apparatus M is thus configured to have a minimized outside dimension in the longitudinal direction, as well as in the transverse direction.

On the lower beam 11 that interconnects the left and right inner mast members 4, there is mounted a free lift cylinder 18 of a ram type or a single-action piston type standing upright in place behind a corresponding one of the left and right inner mast members 4. A chain wheel 19 is attached to an upper end of a rod of the free lift cylinder 18, and a lift chain 20 is applied over the chain wheel 19. The lift chain 20 is secured at one end thereof via a chain anchor bolt to a chain anchor bracket 21 on a side of a cylinder tube of the free lift cylinder 18, and at the other end thereof via another chain anchor bolt to a chain anchor bracket 22 on a side of the lift bracket 12.

Figure 3:
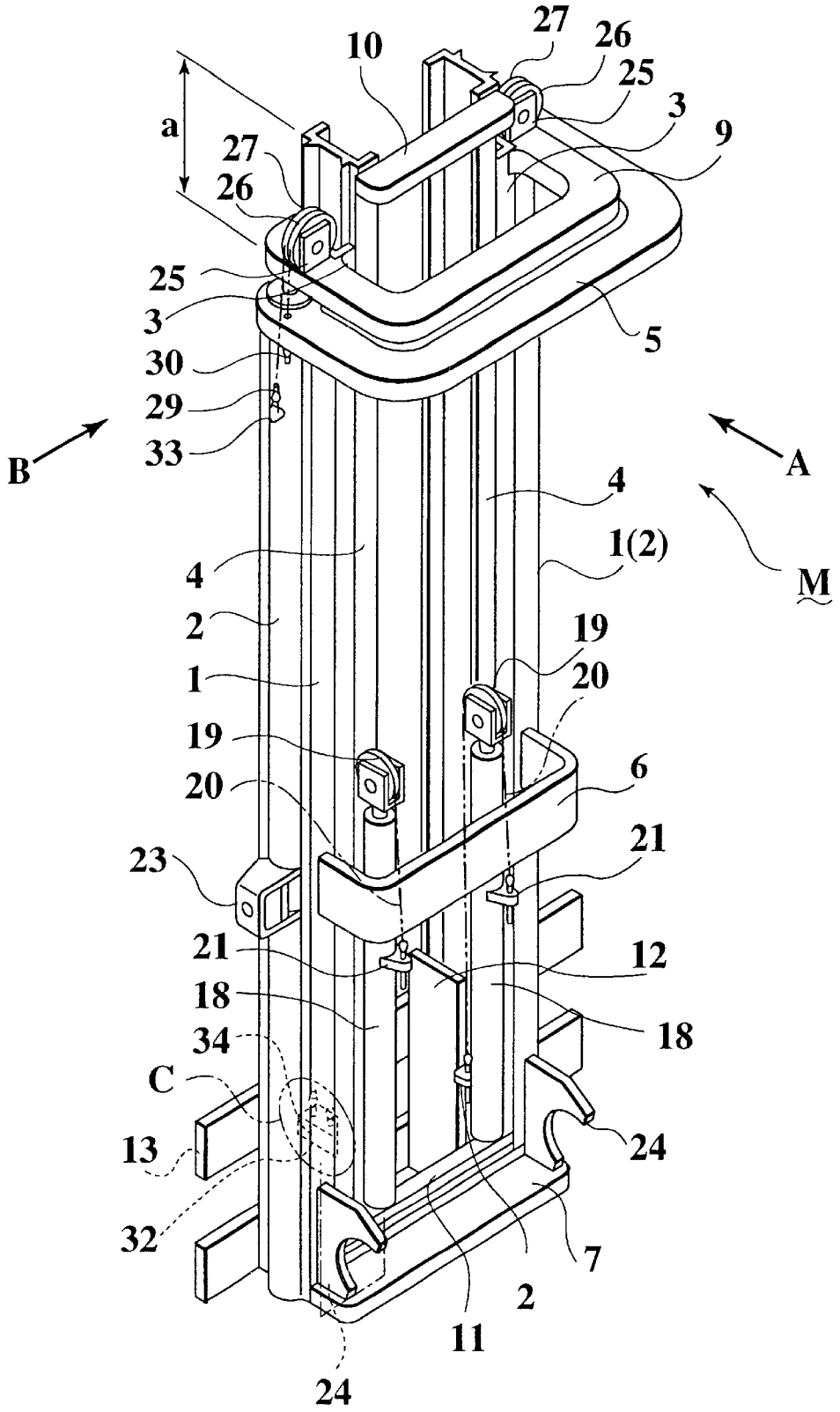
FIG. 3 is a perspective view of the mast apparatus according to the embodiment.

Therefore, when the free lift cylinder 18 is operated to extend from a rod position shown in FIG. 3, the lift bracket 12 solely ascends to a full free lift limit along the inner mast member 4 (a free lift function). And, if the lift cylinder 2 is operated to extend, the lift bracket 12 further ascends, as the middle mast ascends and the inner mast also, as will be described later.

Incidentally, in FIG. 3, designated by reference numeral 23 is a tilt bracket, and 24 is a mast support bracket.

In the embodiment, the upper beam 9, which interconnects the left and right middle mast members 3 with each other, has a pair of left and right chain wheel brackets 25 fixed thereto. Each chain wheel bracket 25 has fixed thereto a corresponding one of a pair of left and right chain wheels 26 and a corresponding one of a pair of left and right hydraulic-hose wheels 27, with their wheel faces extending in parallel in the transverse direction. That wheel 26 has an inner-mast-driving lift chain 28 applied thereover, and this wheel 27 has a hydraulic hose 29 wound thereover. The chain wheel 26 and the hydraulic-hose wheel 27, as well as the chain wheel bracket 25, are accommodated within the level difference 'a' between the middle mast member 3 and the inner mast member 4.

As will be seen from FIGS. 3, 5 and 6, those accommodated components 25, 26 and 27 overlap with each other in the longitudinal direction, as well as with the combination of the outer mast member 1, the middle mast member 3 and the inner mast member 4 in the transverse direction.

The lift chain 28 for driving the inner mast has one end thereof secured via a chain anchor bolt 30 (FIGS. 3, 5, 6) to a corresponding one of left and right ends of the upper beam 5 which interconnects the left and right outer mast members 1, and the other end thereof downwardly lead through a hidden space 31 (FIG. 4) defined between the middle and inner mast members 3 and 4 and secured via a chain anchor bolt assembly 32 (of FIG. 3 comprised of a chain anchor bolt 35 and a nut 36 of FIG. 8) to a lower end portion of the inner mast member 4, in a manner described below. The hydraulic hose 29 has one end thereof secured and hydraulically connected to an upper part of the lift cylinder 2, via a nipple 33 communicating with a hydraulic chamber in this cylinder 2, and the other end thereof downwardly lead through the defined space 31 between the middle and inner mast members 3 and 4, like the lift chain 28, and secured to and hydraulically connected at the lower end portion of the inner mast member 4, in a below-described manner.

Figure 7:
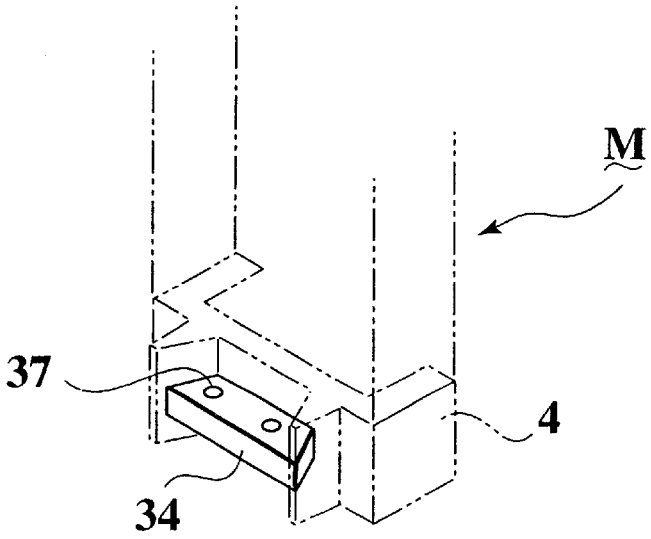
FIG. 7 is a detail of an essential portion of the mast apparatus, at part C of FIG. 3.
Figure 8:
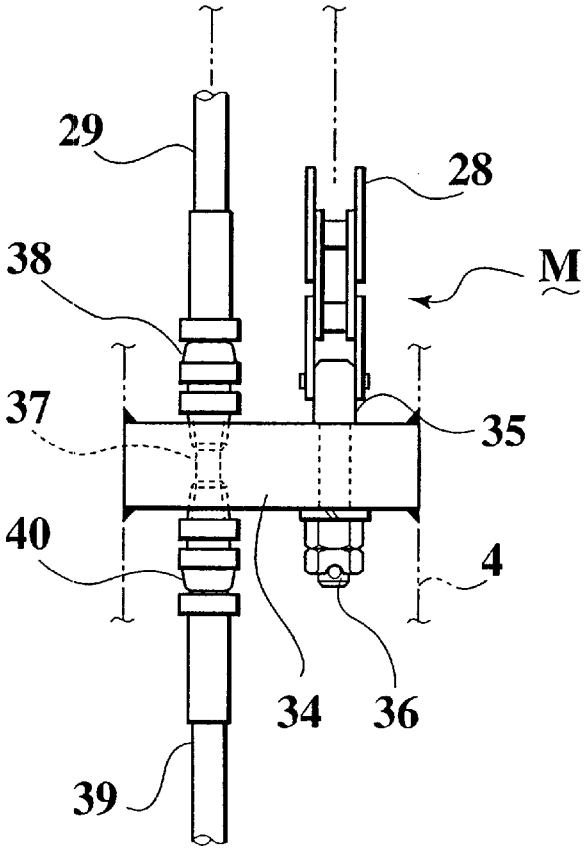
FIG. 8 is a detail of the essential portion of FIG. 7.

As shown in FIGS. 3, 7 and 8, the above-mentioned lower end portion of the inner mast member 4 comprises a chain anchor bracket 34 as a horizontal trapezoidal plate member fixed by welding to a trapezoidal back surface (FIG. 7) of the inner mast member 4, i.e. to respective inner sides of the front and rear ribs 3*b* (FIG. 4) and a back side of the web therebetween. Of both ends of the inner-mast-driving lift chain 28, that one to be secured to the inner mast is fastened to the chain anchor bracket 34 by a combination of the chain anchor bolt 35 provided therethrough and the nut 36 screwed on the bolt 35. The chain anchor bracket 34 has a vertical hydraulic hole or port 37 provided therethrough. Of both ends of the hydraulic hose 29, that one to be secured to the inner mast is connected to an upper end of a nipple 38 whose lower end is applied to an upper end of the hydraulic port 37. Another nipple 40 is applied at its upper end to a lower end of the hydraulic port 37 and connected at its lower end to an end of a hydraulic hose 39.

Accordingly, the inner-mast-driving lift chain 28 as well as the hydraulic hose 29 is substantially kept from exposure to the outside, i.e. resides within the defined space 31, over a vertical length of the space 31 between from the chain wheel 26 to the chain anchor bracket 34.

Figure 9:
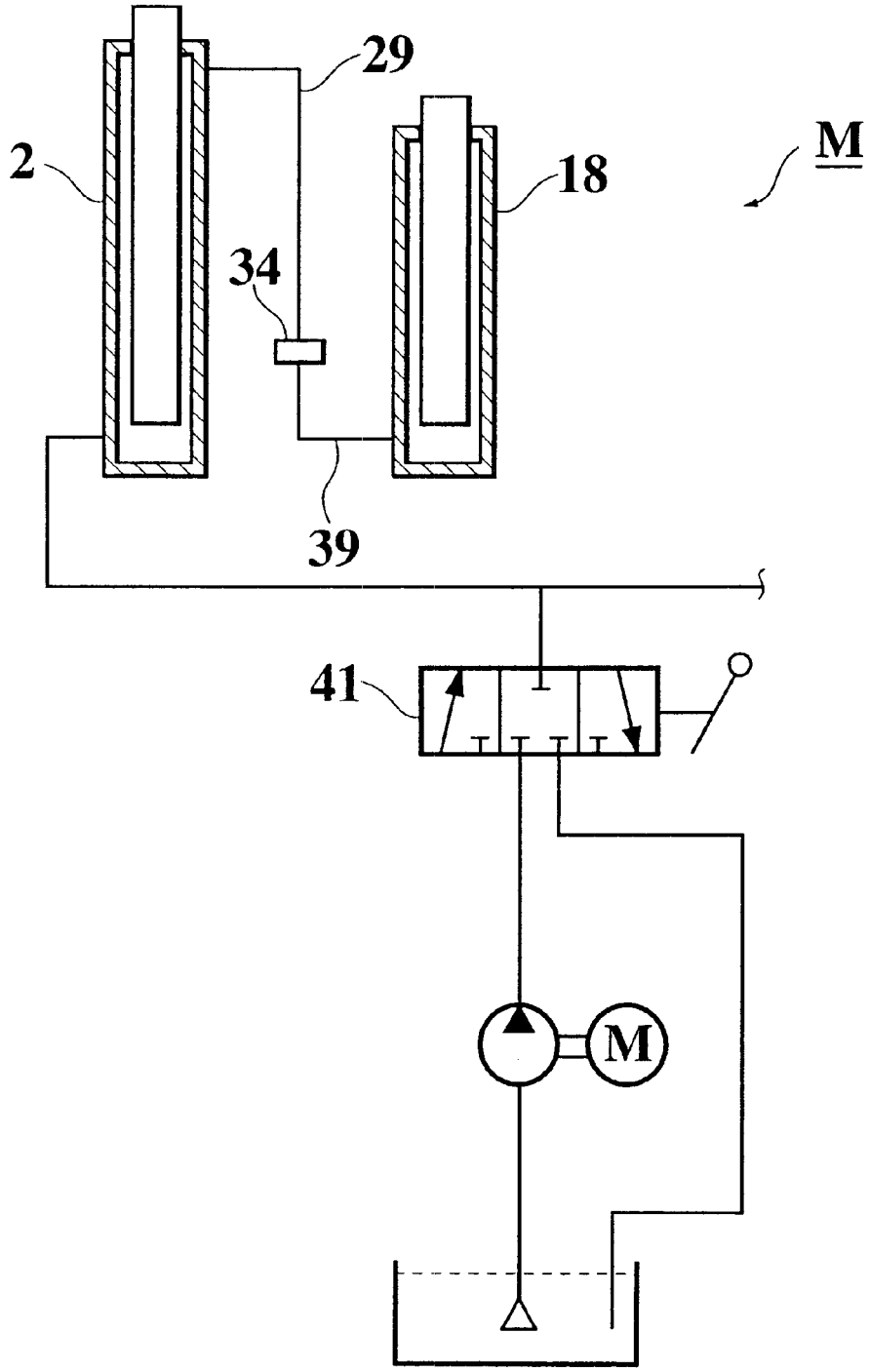
FIG. 9 is a hydraulic circuit diagram of the mast apparatus.

FIG. 9 schematically shows a hydraulic system associated with the mast apparatus M. A hydraulic circuit includes a motor-driven or engine-driven hydraulic pump and a hydraulic oil reservoir, and has a port-switching control valve 41 installed between the pump and the reservoir. The control valve 41 is operative with a cylinder control lever, and supplies a hydraulic pressure to both left and right lift cylinders 2. Each lift cylinder 2 is hydraulically connected to a corresponding one of the left and right free lift cylinders 18, via a combination of the hydraulic hose 29, the port of the chain anchor bracket 34 and the hydraulic hose 39 connected in series, for an extensive supply of hydraulic pressure from the lift cylinder 2 to the free lift cylinder 18. This cylinder 18 has an effective pressure reception area larger than that of that cylinder 2.

When a hydraulic pressure is supplied to the left and right lift cylinders 2 from the control valve 41, a body of hydraulic oil in each lift cylinder 2 outflows toward an associated one of the left and right free lift cylinders 18, exerting pressures thereon, so that initially these cylinders 18 extend, causing simply the left and right lift brackets 12 to ascend until they 18 reach a predetermined upper limit (for a free lift height of the fork F) at an upper end of the inner mast, where they 18 are fully extended. Then, the left and right lift cylinders 2 enter their extension modes, where they 2 push the middle mast to be elevated by a stroke at a speed together with the chain wheel 26 and the hydraulic-hose wheel 27 at each of the left and right sides, thus causing at each side a suspending part of the lift chain 28 as well as that of the hydraulic hose 29 to ascend by a double stroke at a double speed, thereby elevating an entirety of the inner mast including the chain anchor brackets 34 by the double stroke at the double speed, together with the free lift cylinders 18 and the lift brackets 12 as well as the finger bar 13 and the fork F.

The inner-mast-driving lift chain 28 and the hydraulic hose 29 are both accommodated and hidden, at their portions between from the chain wheel 26 to the chain anchor bracket 34, in the space 31 between the middle mast member 3 and the inner mast member 4, and a rear side of a combination of the mast members looks clear with a defined configuration at each of the left and right sides. Further, the hidden portions do not interrupt a sight field of the operator, never split the sight nor kill in part, permitting a defined and improved sight field with a wide angle due to a minimized transverse width at both the left and right sides of the combination of mast members.

In addition, the inner mast member 4 has a higher mast height than the middle mast member 3 by the predetermined level difference 'a', and the chain wheel 26 of the inner-mast-driving lift chain 28 is provided at an upper end part of the middle mast member 3 and accommodated within the level difference 'a'. Therefore, the free lift stroke for the lift bracket 12 to be solely elevated and lowered therein relative to the inner mast member 4 simply depends on a length of the inner mast member 4 which is rendered longer by the predetermined amount of level difference 'a', without direct restrictions due to lengths of the outer mast member 1 and the middle mast member 3. Accordingly, a longer free lift stroke is secured as a matter of course, in addition to that the chain wheel 26 projecting above the middle mast member 3 does not exceed the height of the inner mast member 4 and, such when the fork lift truck T travels, the chain wheel 26 is well protected from a collision with obstacles such as an external structure.

Figure 10:
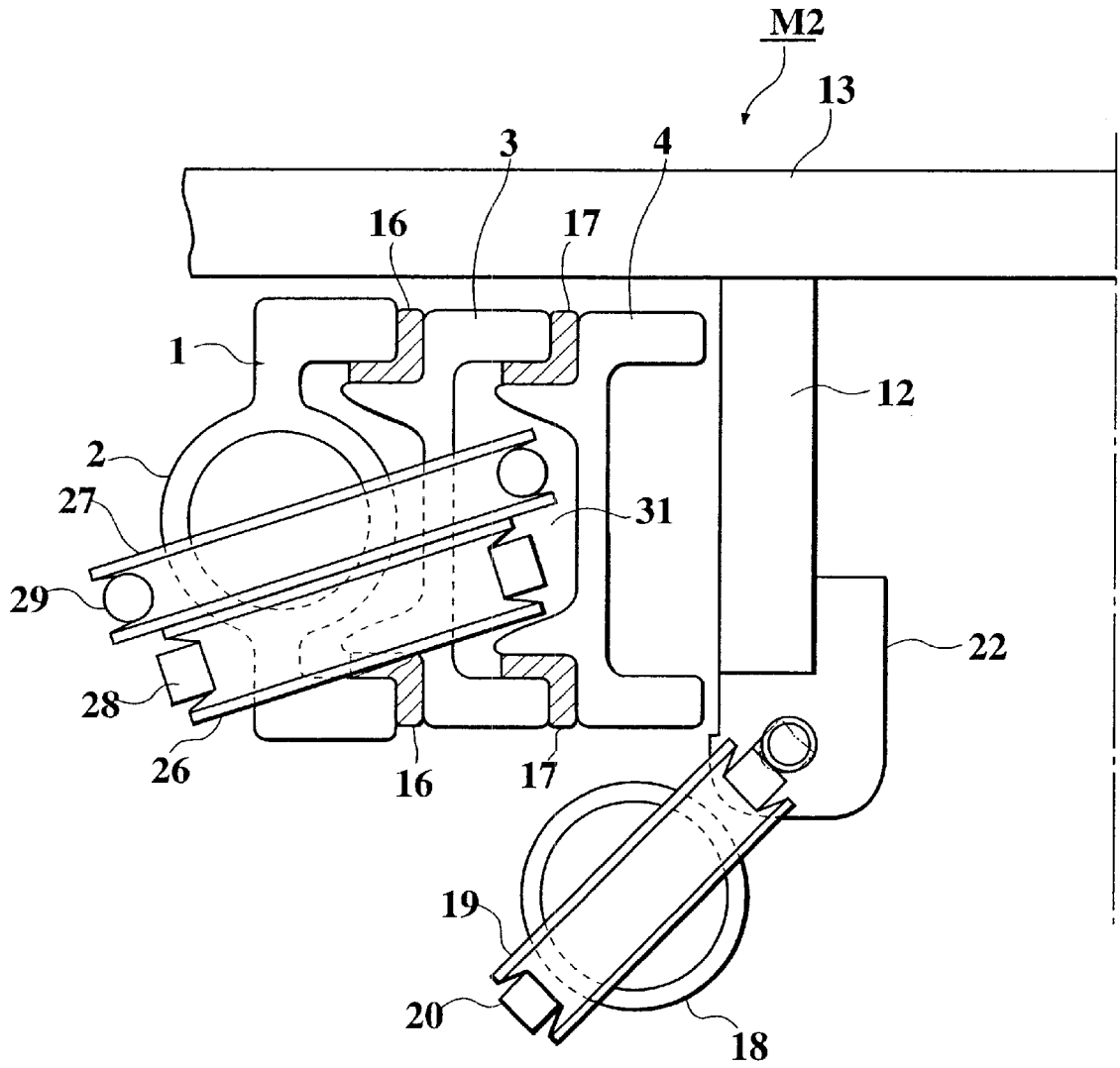
FIG. 10 is a plan of an essential portion of a mast apparatus according to another embodiment of the invention.

FIG. 10 shows a second embodiment of the invention, which is different from the first embodiment in that, as will be seen from comparison with FIG. 4, a chain wheel 19 for a lift chain 20 to be applied thereover, a chain wheel 26 for an inner-mast-driving lift chain 28 to be applied thereover and a wheel 27 for a hydraulic hose 29 to be wound thereover are each inclined at a predetermined angle, having like effects to the first embodiment.

Figure 11:
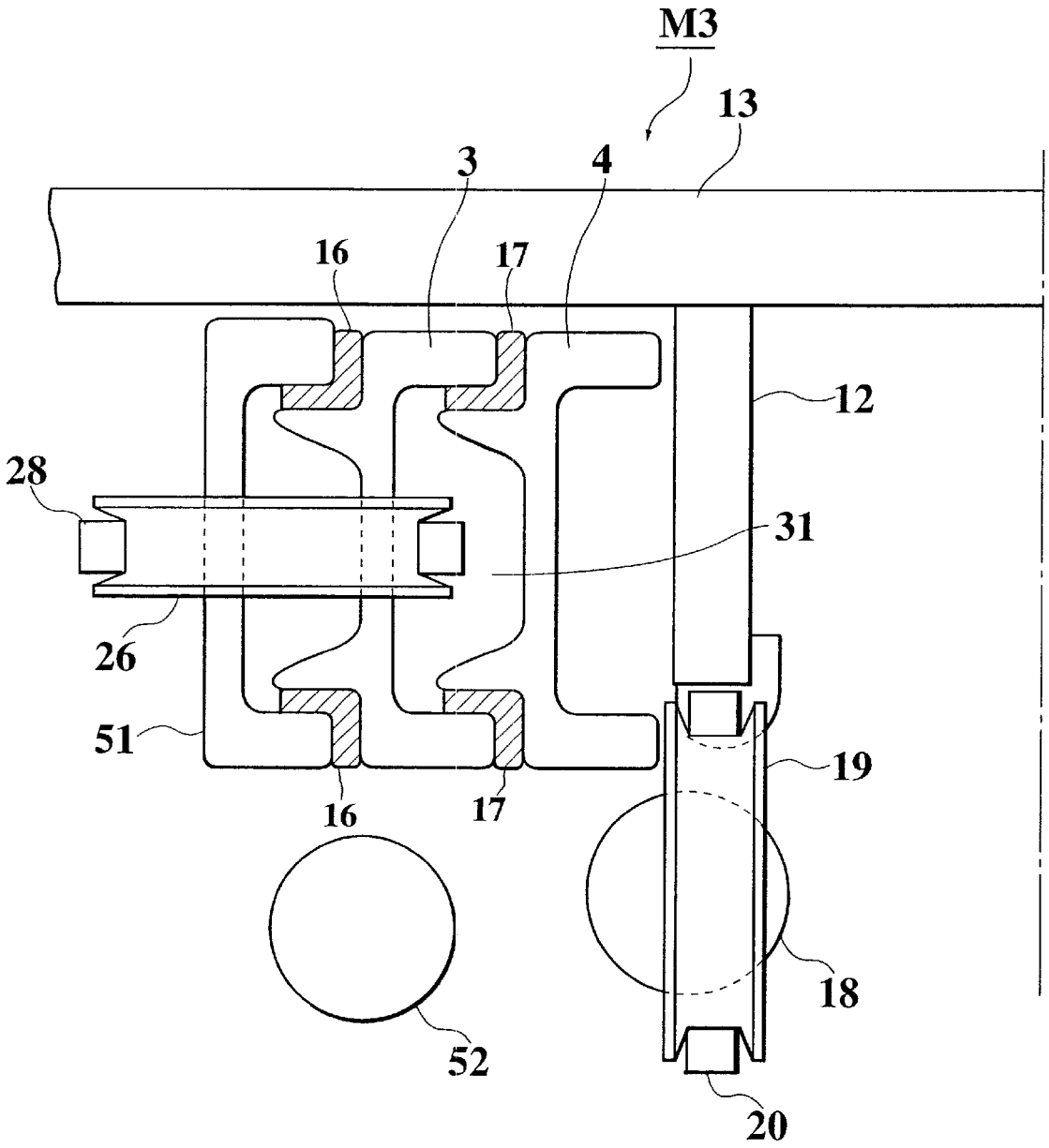
FIG. 11 is a plan of an essential portion of a mast apparatus according to another embodiment of the invention.

FIG. 11 shows a third embodiment of the invention, which is different from the foregoing embodiments in that it employs a lift cylinder 52 as a ram type cylinder or a piston type cylinder separated from and arranged behind an outer mast member 51; and an inner-mast-driving lift chain 28 applied over a chain wheel 26 and accommodated, along a suspending connection portion thereof between the chain wheel 26 and an end of the chain 28 connected to an inner mast member 4, in a vertical hidden space 31 defined between the inner mast member 4 and a middle mast member 3.

In this embodiment, the suspending portion of the lift chain 28 between from the chain wheel 26 to a chain anchor bracket 34 (FIGS. 7 and 8) is hidden in the space 31 between the middle and inner mast members 3 and 4, and provides a clear rear side view of a corresponding degree to each of left and right combinations of mast members, when compared with a conventional structure, in addition to that the hidden chain portion does not interfere with an operator's sight, and that the operator's sight has a wide angle due to a minimized transverse width of each combination of the mast members.

Figure 12A:
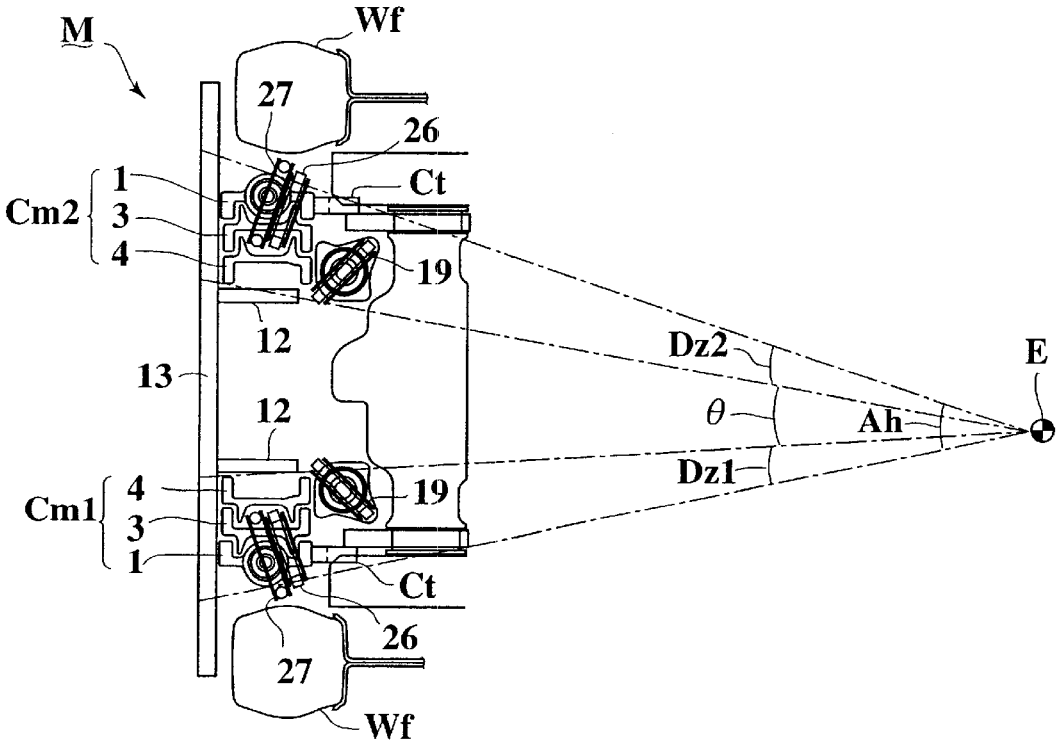
FIGS. 12A and 12B are illustrations describing a horizontal sight angle of an operator.
Figure 12B:
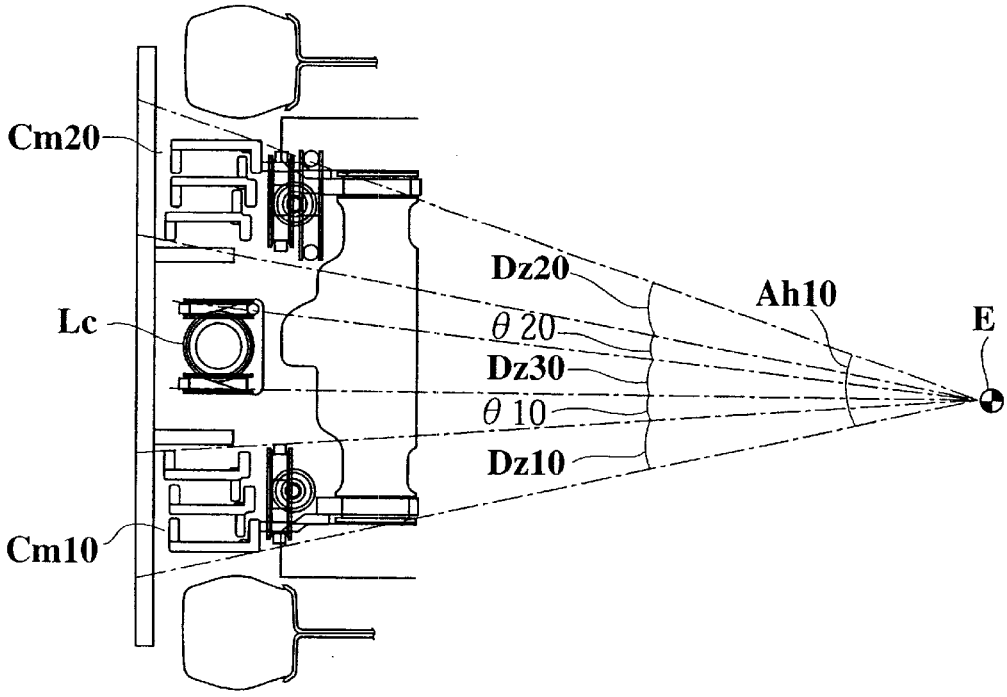
FIG.12B (PRIOR ART)

FIGS. 12A and 12B describes a horizontal sight angle of an operator in a comparing manner.

FIG. 12B shows a single lift cylinder Lc provided in a central region of of a mast member, i.e. between a left mast member combination Cm10 and a right mast member combination Cm20. At a normal eye point E, the operator has a horizontal sight angle Ah10 including a left dead zone Dz10 corresponding to the left mast member combination Cm10, a right dead zone Dz20 corresponding to the right mast member combination Cm20 and a central dead zone Dz30 corresponding to the lift cylinder Lc, leaving as an effective sight angle a split combination of a left free sight angle θ 10 and a right free sight angle θ 20.

In FIG. 12A illustrating a mast apparatus M representative of respective one of the embodiments described and including a left combination Cm1 of outer, middle and inner mast members 1, 3 and 4 and a right combination Cm2 of outer, middle and inner mast members 1, 3 and 4, the operator has, at his or her normal eye point E, a horizontal sight angle Ah having simply a left dead zone Dz1 corresponding to the left mast member combination Cm1 and a right dead zone Dz2 corresponding to the right mast member combination Cm2, with no central dead zone, thus allowing for the operator to have an increased and clear effective sight angle comprising a single, wide free sight angle θ.

Figure 13:
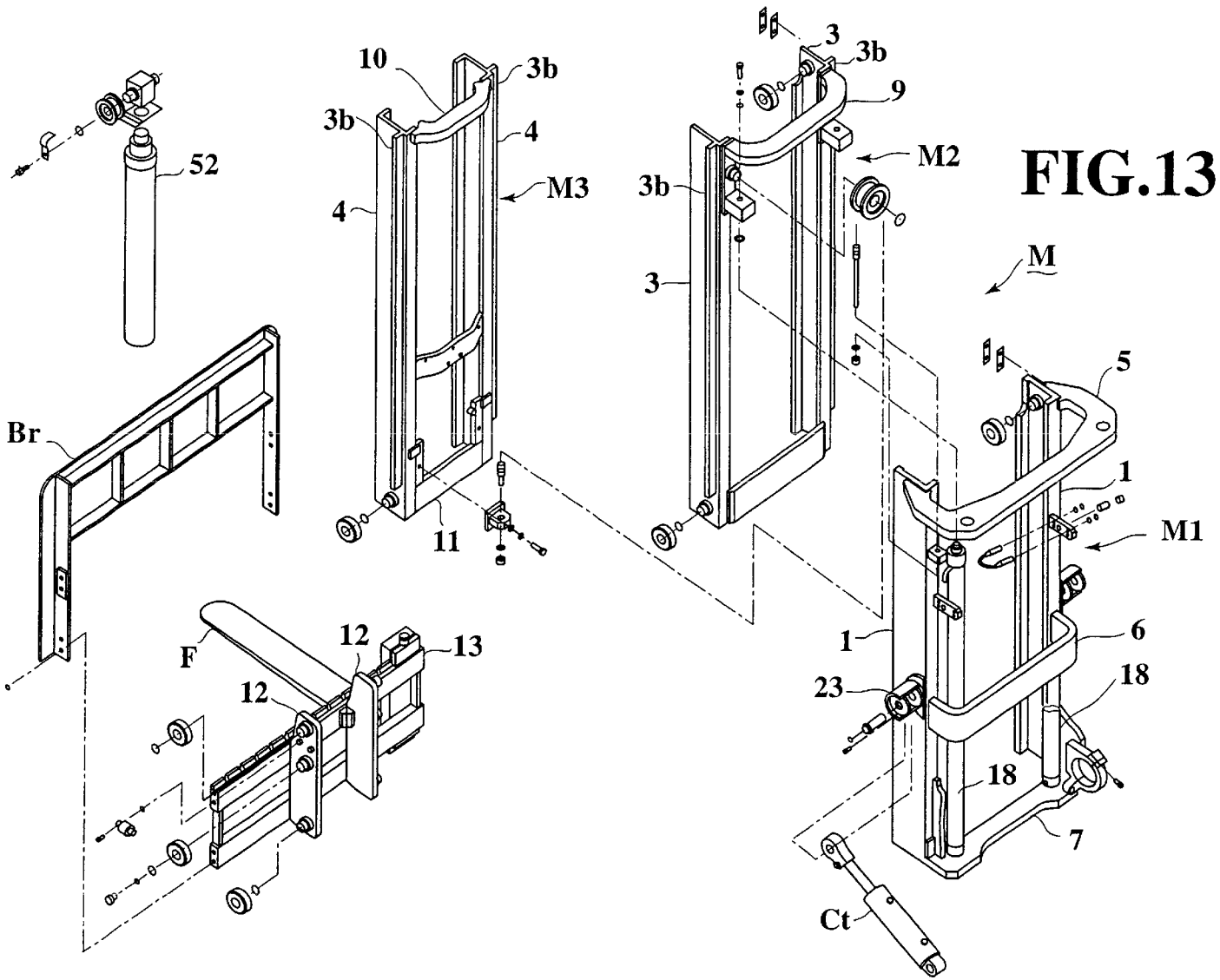
FIG. 13 is an exploded view of a mast apparatus according to a modification of the embodiment of FIG. 11.

FIG. 13 is an exploded view of a mast apparatus M according to a modification of the third embodiment of the invention, in which some components are modified to show a variety of possible applications of the invention, e.g. middle and inner mast members 3 and 4 each simply have a front rib 3*b* formed on its outer side, without a left rib (3*a* of FIG. 4), to achieve like effects to the embodiments described. Like the other embodiments, the mast apparatus M comprises an outer mast M1 with a pair of left and right outer mast members 1 joined to be rigid in a bridging manner described, a middle mast M2 with a pair of left and right middle mast members 3 joined to be rigid in a bridging manner described, and an inner mast M3 with a pair of left and right inner mast members 4 joined to be rigid in a bridging manner described, in addition to a combination a pair of left and right free lift cylinders 18 and a pair of left and right lift cylinders 52, lift brackets 12, a finger bar 13, tilt cylinders Ct, etc., and attachments such as a fork F and a load-backrest Br.

It will be seen from the foregoing description that, according to the embodiments of the invention, a hydraulic hose connected to a free lift cylinder is arranged in a space defined between an inner mast member and a middle mast member, together with a chain for driving the inner mast member to be elevated and lowered.

The drive chain for elevation of the inner mast member is wound over a chain wheel provided above of the middle mast member, and is connected at one end thereof the inner mast member and at the other end thereof to the outer mast member, and its suspending portion between from the chain wheel to a connecting part to the inner mast member is accommodated within the space between the inner and middle mast members, and is kept from exposure to the outside.

Further, a pair of left and right free lift cylinders are arranged behind a pair of left and right combinations of mast members.

A suspending portion of a hydraulic hose wound in a similar manner to the lift chain also is accommodated in the space defined between the inner and middle mast members, together with the chain.

As the lift chain and the hydraulic hose are both arranged in the space between the inner mast member and the middle mast member, significant effects are given to render the operator's sight clear and wide.

Further, a pair of left and right outer mast members each have a cylinder tube of a lift cylinder integrally formed therein, and the lift cylinder is constituted as a ram type cylinder.

Accordingly, a pair of left and right combinations of mast members and a pair of free lift cylinders independently provided at the left and right overlap each other in a transverse direction, and the left and right mast member combinations including the free lift cylinders are each respectively minimized in outside dimensions.

A pair of left and right free lift cylinders independently provided at the left and right are arranged behind left and right mast members corresponding thereto, and an outside dimension of each mast member combination is minimized in a transverse direction, with an enhanced effect to render an operator's front sight wide.

Further, the other end of the hydraulic hose connected to the free lift cylinder is connected to an upper end part of the lift cylinder.

Since the left and right outer mast members each have a lift cylinder formed substantially as an integral unit, an outside dimension is minimized in a transverse direction in regard of the outer mast member including the lift cylinder, as well as of the combination of mast members.

A pair of left and right outer mast members each have a ram type lift cylinder integrated thereto, with a minimized outside dimension in a transverse direction of each of left and right mast member combinations including the lift cylinder, providing a wide siight to an operator.

Further, the lift cylinder is constituted as a ram type cylinder, and the other end of the hydraulic hose connected to the free lift cylinder is connected to an upper end part of the lift cylinder, communicating with a hydraulic chamber of the ram type lift cylinder.

Accordingly, a hydraulic pressure can be supplied to the free lift cylinder in a simple hose layout.

Since the other end of the hydraulic hose connected to the free lift cylinder is connected to the upper end part of the ram type lift cylinder, a piping system for the free lift cylinder is simplified, with the more defined sight.

Further, a hydraulic hose wheel provided at an upper end part of the middle mast member, for the hydraulic hose to be wound thereover, is accommodated within a difference in level between the inner mast member and the middle mast member, together with the chain wheel.

Accordingly, a secure protection is possible not only of the chain wheel but also of the hydraulic hose wheel.

The hydraulic hose wheel provided at the upper end part of the middle mast member is accommodated within the level difference between the inner and middle mast members together with the chain wheel, the hydraulic hose wheel is protected by the height of the inner mast member from a collision with an obstacle such as an external structure, such as when a fork lift truck travels.

Further, the lift cylinders and the free lift cylinders are respectively provided in an independent or separated manner at the left and right sides.

The free lift cylinders are independent at the left and right sides, there is no obstacle interrupting an operator's sight in a central region of the mast apparatus, thus permitting a wide front sight as well as an increased free lift stroke.

Since the lift cylinders and the free lift cylinders are respectively provided to be independent at the left and right sides, there is no obstacle interrupting the sight in the central region of the mast apparatus, and a loading service is facilitated in addition to the front sight is rendered wide and the free lift stroke is rendered long.

Further, the left and right outer mast members and cylinder tubes of the lift cylinders corresponding thereto are formed as integral units, and the lift cylinder is formed as a ram type cylinder, and a hydraulic hose wound over a wheel therefor serves for connection of an upper end part of the lift cylinder to the free lift cylinder.

Since the left and right outer mast members and the lift cylinders are substantially formed as integral units, an outside dimension in a transverse direction of the outer mast member including the lift cylinder, particularly those of the left and right mast member combinations can be minimized. Further, the lift cylinder itself is structured to be a ram type cylinder and the other end of the hydraulic hose connected to the free lift cylinder is connected to the upper end part of the lift cylinder, communicating with a hydraulic chamber of the ram type lift cylinder, allowing for the free lift cylinder to have a simplified hydraulic circuit therefor.

As the left and right outer mast members and the cylinder tubes of the lift cylinders corresponding thereto are formed as integral units in which each lift cylinder is formed as a ram type cylinder and the hydraulic hose wound over the wheel therefor interconnects between the upper end part of the lift cylinder and the free lift cylinder, an outside dimension in a transverse direction of each of the left and right mast member combinations including the lift cylinder can be minimized, so that an increased sight angle can be realized, and a hydraulic circuit for the free lift cylinder is rendered simple, permitting the clearer sight.

While preferred embodiments of the present invention have been described using specific terms, such description is for illustrative purposes, and it is to be understood that changes and variations may be made without departing from the spirit or scope of the following claims.

What is claimed is:

1. A mast apparatus of a triple mast type as a slide type full free lift mast, the mast apparatus comprising:

a mast combination comprised of an inner mast member, a middle mast member and an outer mast member, with a vertically extending inter-mast space enclosed on at least one vertical side by a connected combination of the inner mast member, the middle mast member, and a guide member between the inner and middle mast members;

a combination of a free lift cylinder and a lift cylinder provided for the mast combination; and a chain for driving the inner mast member, the chain extending in the inter-mast space, with one end thereof connected to the lower side of the inner mast member and the other end thereof connected to the outer mast member side.

2. The mast apparatus as claimed in claim 1, further comprising a hydraulic hose connected at one end thereof to the free lift cylinder, the hydraulic hose extending in the inter-mast space, along with the chain for driving the inner mast member.

3. The mast apparatus as claimed in claim 1, wherein the free lift cylinder is disposed behind a mast member of the mast combination.

4. The mast apparatus as claimed in claim 2, wherein the lift cylinder comprises a ram type cylinder having a cylinder tube that is unitarily formed with the outer mast member.

5. The mast apparatus as claimed in claim 4, wherein the hydraulic hose is connected at another end thereof to an upper end part of the lift cylinder.

6. A mast apparatus of a triple mast type as a full free lift mast provided with a lift bracket, the mast apparatus comprising:

a mast combination comprised of an inner mast member, a middle mast member and an outer mast member, the inner mast member being higher in top level than the middle and outer mast members, as the lift bracket is held in a lowest position thereof, the mast combination having a vertically extending inter-mast space enclosed on at least one vertical side by a connected combination of the inner mast member, the middle mast member, and a guide member between the inner and middle mast members;

a chain for driving the inner mast member to be elevated and lowered, the chain extending in the inter-mast space, with one end thereof connected to the lower side of the inner mast member and the other end thereof connected to the outer mast member side; and a chain wheel for the chain to be applied thereover, the chain wheel being provided at an upper end part of the middle mast member and residing between a top level of the inner mast member and a top level of the middle mast member.

7. The mast apparatus as claimed in claim 6, further comprising a hydraulic hose wheel provided for a hydraulic hose to be wound thereover at an upper end part of the middle mast member, the hydraulic hose wheel residing between the top level of the inner mast member and the top level of the middle mast member.

8. The mast apparatus as claimed in claim 6, further comprising a combination of a free lift cylinder and a lift cylinder provided for the mast combination.

9. The mast apparatus as claimed in claim 8, wherein the lift cylinder comprises a ram type cylinder having a cylinder tube thereof integrated to the outer mast member, and a hydraulic hose is connected at one end thereof to the free lift cylinder and at another end thereof to an upper end part of the lift cylinder.

10. A mast apparatus according to claim 1, wherein the inter-mast space is totally enclosed along a length thereof by the inner mast member, the middle mast member, and guide members between the inner and middle mast members.

11. A mast apparatus according to claim 6, wherein the inter-mast space is totally enclosed along a length thereof by the inner mast member, the middle mast member, and the guide members between the inner and middle mast members.

* * * * *